US005816267A

United States Patent [19]

Chou

[11] Patent Number: 5,816,267

[45] Date of Patent: Oct. 6, 1998

[54] BARRETTE COMBINED WITH A COMB

[76] Inventor: Kuo-Hua Chou, No. 17, Alley 10, Lane 118, Su-Wei Rd., Wu-Ku Hsiang, Taipei County, Taiwan

[21] Appl. No.: 880,872

[22] Filed: Jun. 23, 1997

[51] Int. Cl.[6] ..... A45D 24/10; A45D 8/30

[52] U.S. Cl. ..... 132/145; 132/148; 132/125; 132/278

[58] Field of Search ..... 132/145, 278, 132/125, 121, 129, 142, 146, 148, 279, 275, 273, 277, 137

[56] References Cited

U.S. PATENT DOCUMENTS

| | | | |
|---|---|---|---|
| D. 47,147 | 3/1915 | Weitling | 132/125 |
| 1,354,236 | 9/1920 | Bour | 132/279 |
| 2,030,603 | 2/1936 | McLaughlin | 132/273 |
| 2,633,591 | 4/1953 | Servilla | 132/142 |
| 3,565,084 | 2/1971 | Vuillard | 132/279 |
| 3,841,340 | 10/1974 | Solomon | 132/279 |
| 4,976,277 | 12/1990 | Yasuda | 132/279 |
| 5,396,912 | 3/1995 | Chou | 132/279 |
| 5,657,775 | 8/1997 | Chou | 132/125 |

*Primary Examiner*—Todd E. Manahan
*Assistant Examiner*—Eduardo C. Robert
*Attorney, Agent, or Firm*—Rosenberg, Klein & Bilker

[57] ABSTRACT

A barrette combined with a comb is provided that includes an elongated base plate having a retainer unit at one end and two upright lugs bilaterally disposed at an opposite end. A clamping plate is included that has a fixed end pivoted to the upright lugs of the base plate and a free end formed with a coupling that is adapted for coupling to the retainer unit of the base plate. A comb strip is also included that is pivotally coupled to the retainer unit of the base plate. The comb strip has longitudinal rows of teeth and is displaceable between a first position, in which the comb strip is closed on the base plate and retained thereto by the clamping plate, and a second position in which the cob strip is extended out of the base plate and secured in the extended position by the clamping plate for cleaning and smoothing the hair.

1 Claim, 6 Drawing Sheets

BARRETTE COMBINED WITH A COMB

BACKGROUND OF THE INVENTION

The present invention relates to barrettes for holding a woman's hair, and more particularly to such a barrette which can be arranged into the form of a hairbrush for cleaning and smoothing the hair.

A regular barrette is generally comprised of an elongated, smoothly arched base plate having two upright lugs bilaterally disposed at one end and a retainer unit disposed at an opposite end, and an arched clamping plate having a fixed end pivoted to the upright lugs of the base plate and a free end releasably secured to the retainer unit of the base plate. The arched clamping plate has two longitudinal slots disposed in parallel and defining an arched springy strip therebetween. When in use, the free end of the clamping plate is secured to the retainer unit of the base plate, permitting the hair to be retained between the clamping plate and the base plate and held down by the arched springy strip of the clamping plate. This structure of barrette has drawbacks. Because engagement position between the free end of the clamping plate and the retainer unit of the base plate is not adjustable, the clamping force of the clamping plate cannot be adjusted subject to the volume of hair to be clamped. Another drawback of this structure of barrette is that the hair tends to be stretched or damaged when closing or opening the clamping plate. Furthermore, this structure of barrette can only be used for holding the hair, it cannot be used for hairbrush means for cleaning or smoothing the hair.

SUMMARY OF THE INVENTION

The present invention has been accomplished under the circumstances in view. It is one object of the present invention to provide a barrette which can be conveniently adjusted subject to the volume of hair to be clamped. It is another object of the present invention to provide a barrette which can be arranged into the form of a hairbrush for cleaning and smoothing the hair. According to one aspect of the present invention, the barrette comprises an elongated base plate having a retainer unit at one end and two upright lugs bilaterally disposed at an opposite end, and a clamping plate having a fixed end pivoted to the upright lugs of the base plate and a free end made with coupling means adapted for securing to the retainer unit of the base plate, wherein a comb strip is coupled to the retainer unit of the base plate and set between a first position in which the comb strip is closed on the base plate and retained thereto by the clamping plate, and a second position in which the comb strip is extended out of the base plate and secured in the extended position by the clamping plate for cleaning and smoothing the hair, the comb strip comprising two horizontal pivot rods bilaterally disposed at a fixed end thereof and respectively pivoted to the retainer unit of the base plate, two shoulders bilaterally disposed at a free end thereof which are forced into engagement between the upright lugs of the base plate when the comb strip is turned to the first position, and longitudinal rows of teeth raised between its fixed end and free end for cleaning and smoothing the hair. According to another aspect of the present invention, the retainer unit of the base plate comprises two hooked retaining strips having vertically spaced hooked portions adapted for adjustably securing the coupling means of the free end of the clamping plate to hold down the hair by a proper clamping force.

DETAILED DESCRIPTION OF THE PREFERRED EMBODIMENT

Figure 1:
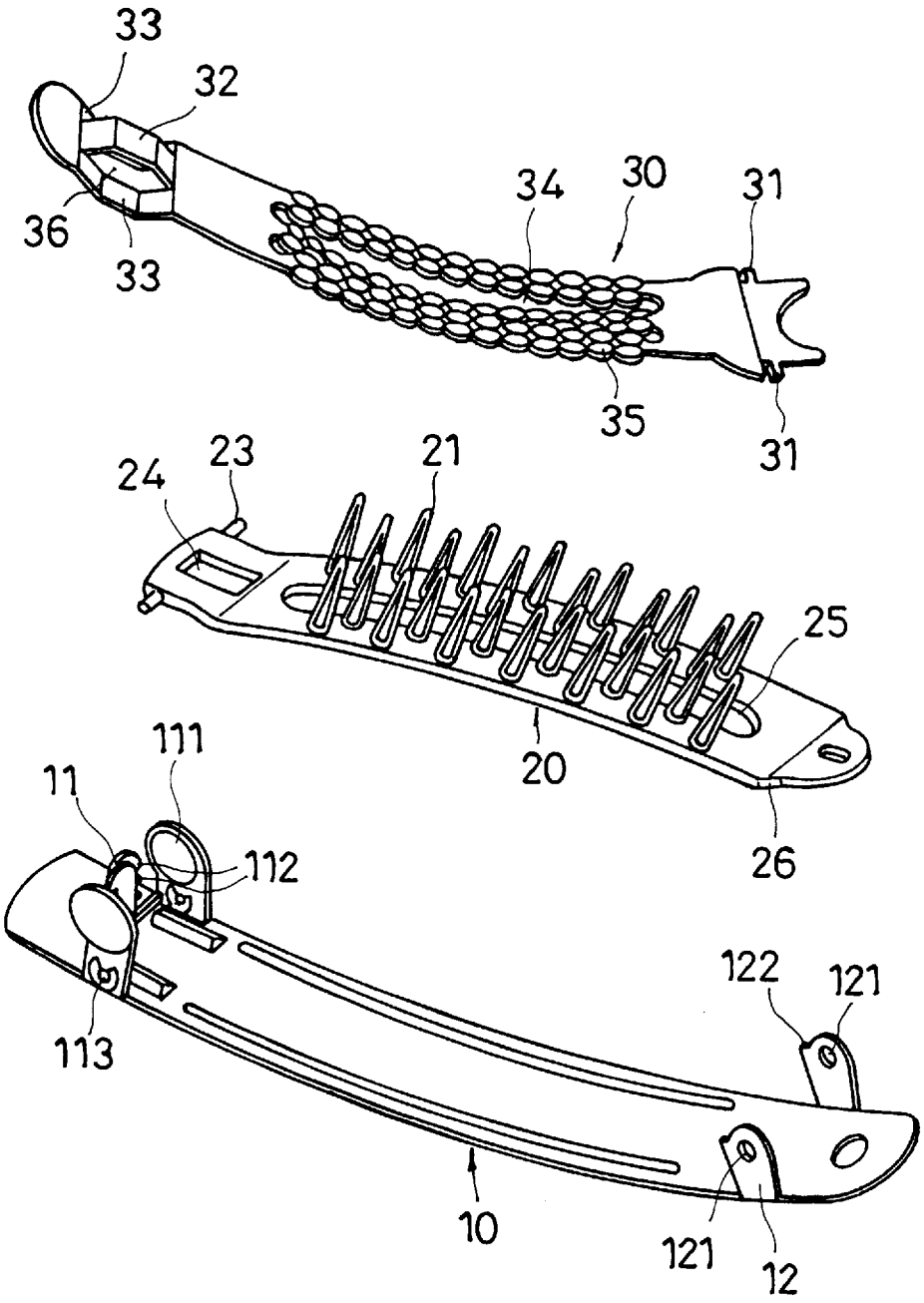
FIG. 1 is an exploded view of a barrette according to one embodiment of the present invention.
Figure 2:
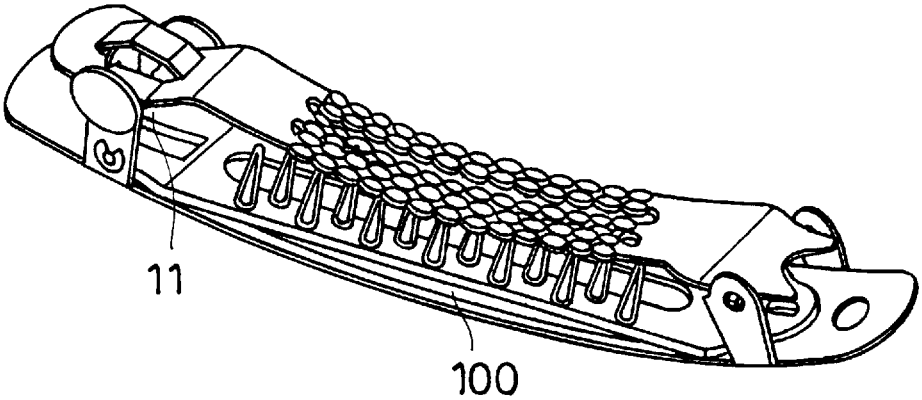
FIG. 2 is an elevational assembly view of the barrette shown in FIG. 1 when closed.
Figure 3:
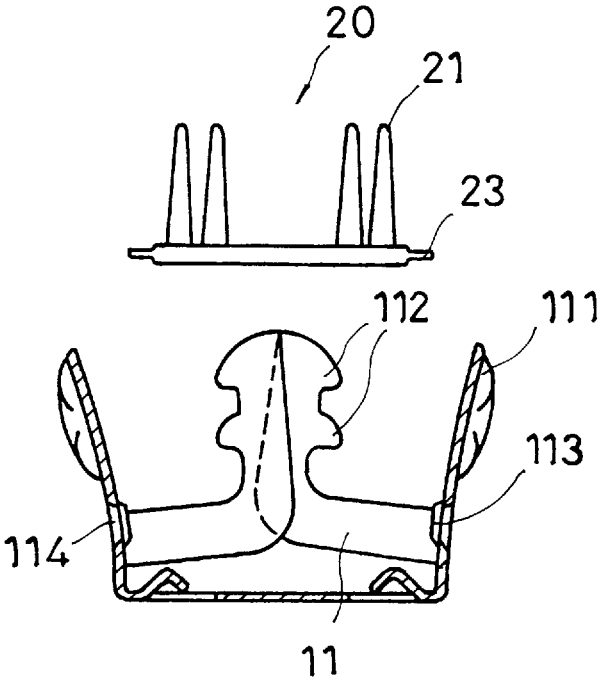
FIG. 3 is a cross sectional view of the comb strip and the base plate according to the present invention.
Figure 3A:
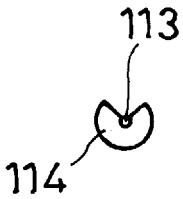
FIG. 3*a* is an enlarged view of a part of FIG. 3.

Referring to FIGS. 1, 2, 3 and 3*a*, a barrette in accordance with the present invention is generally comprised of an elongated base plate 10, a comb strip 20, and a clamping plate 30. The base plate 10 comprises a retainer unit 11 disposed at one end, and two upright lugs 12 bilaterally disposed at an opposite end. The retainer unit 11 comprises two upright finger strips 111 bilaterally raised from one end of the base plate 10, and two hooked retaining strips 112 respectively raised from the upright finger strips 111 at an inner side (see FIG. 3). Each upright finger strip 111 has a sector recess 114 disposed at an inner side near the bottom and defining a recessed pivot hole 113 (see FIG. 3*a*). Each upright lug 12 comprises a pivot hole 121, and a springy shoulder 122.

Figure 6A:
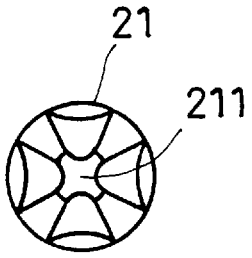
FIG. 6*a* is a cross sectional view of the conical tooth shown in FIG. 6.
Figure 7A:
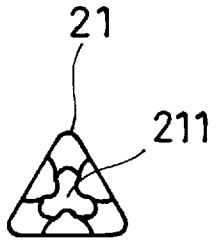
FIG. 7*a* is a cross sectional view of the pyramidal tooth shown in FIG. 7.
Figure 6:
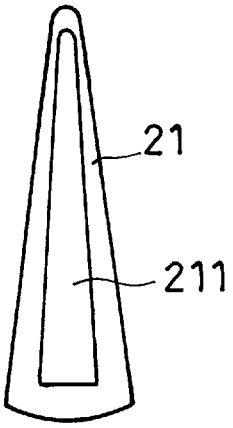
FIG. 6 shows a conical tooth for the comb strip according to the present invention.
Figure 7:
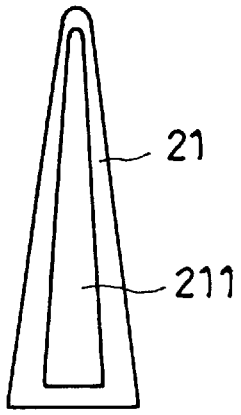
FIG. 7 shows a pyramidal tooth for the comb strip according to the present invention.

The comb strip 20 is smoothly arched, comprising a longitudinal slot 25, rows of upright teeth 21 longitudinally disposed at two opposite sides of the longitudinal slot 25, a coupling hole 24 at one end which receives the hooked retaining strips 112 of the base plate 10, two horizontal pivot rods 23 disposed at two opposite sides of the coupling hole 24 and respectively pivoted to the recessed pivot holes 113 of the finger strips 111 of the base plate 10, and two shoulders 26 adapted to engage the shoulders 122 of the upright lugs 12 of the base plate 10. The longitudinal slot 25 diminishes material consumption, and improves the springy power of the comb strip 20. The teeth 21 may be variously shaped. For example, the teeth 21 can have the shape of a cone (see FIGS. 6 and 6*a*), or the shape of a pyramid (see FIGS. 7 and 7*a*). Each tooth 21 defines a receiving hole 211 (see FIGS. 6, 6*a*, 7 and 7*a*) for receiving dust and scalp chips.

Figure 8:
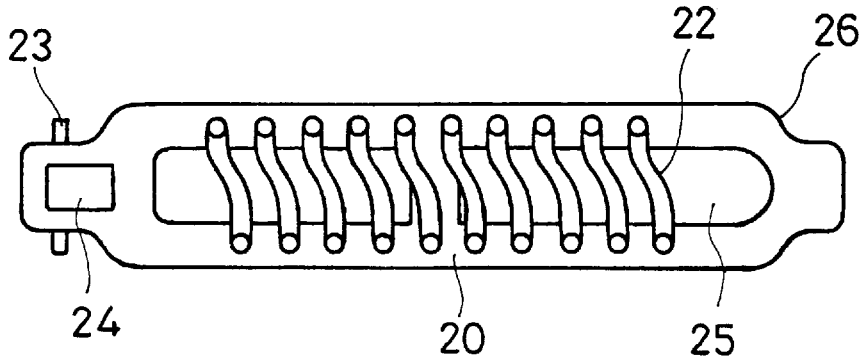
FIG. 8 shows an alternate form of the comb strip with wave-like teeth according to the present invention.
Figure 9:
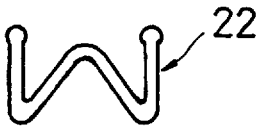
FIG. 9 shows a tooth with a W-shaped profile for the comb strip according to the present invention.
Figure 10:
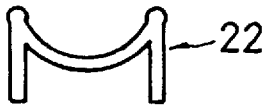
FIG. 10 shows a tooth with a M-shaped profile for the comb strip according to the present invention.
Figure 11:
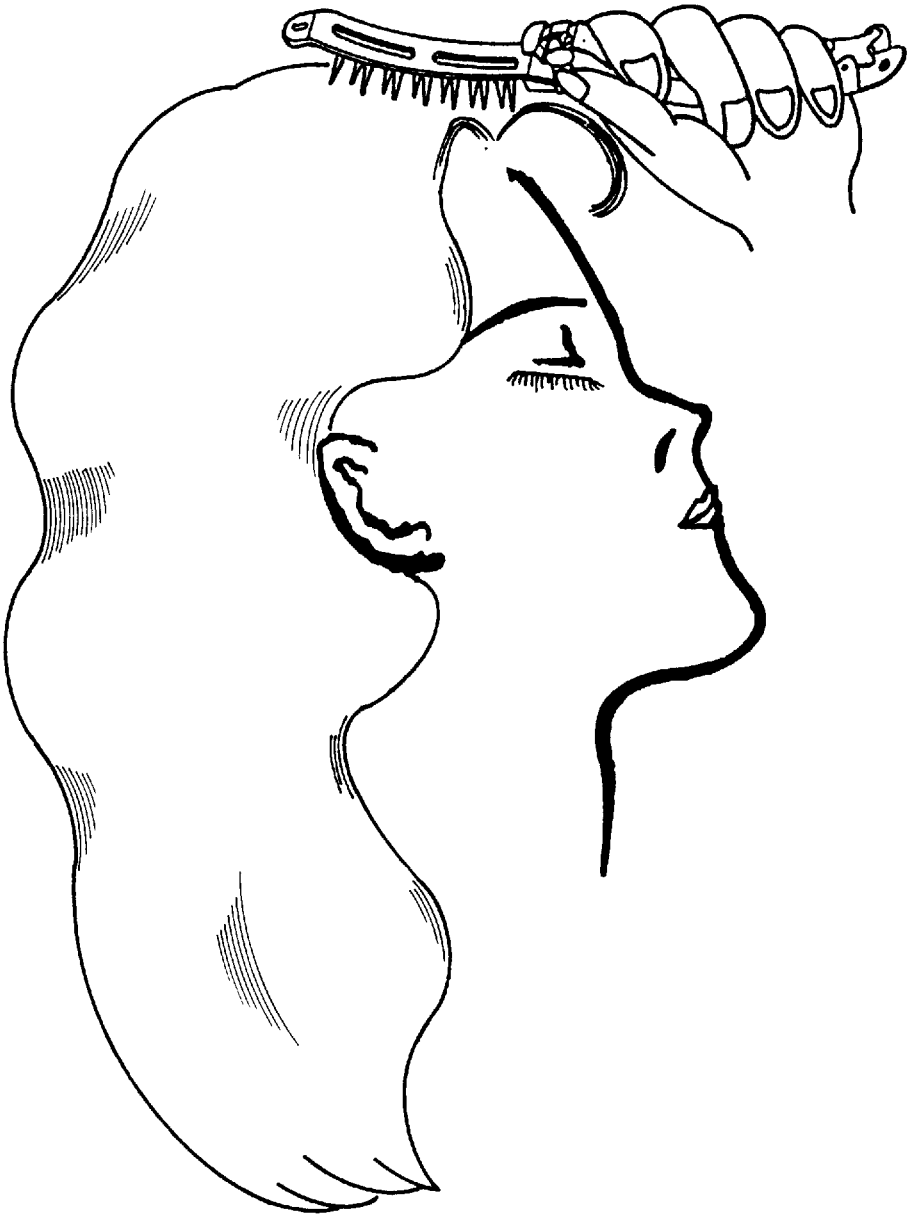
FIG. 11 is an applied view of the present invention, showing the barrette arranged into the form of a hairbrush and used.

FIG. 8 shows an alternate form of the comb strip 20. According to this alternate form, the comb strip 20 comprises a plurality of wave-like teeth 22. The wave-like teeth 22 can have a W-shaped profile as shown in FIG. 9, or a M-shaped profile as shown in FIG. 10.

The clamping plate 30 is smoothed arched, having pivot rods 31 bilaterally disposed at one end, an integral arch strip 35 longitudinally disposed in the middle, two longitudinal slots 34 disposed in parallel and separated by the arch strip 35, a coupling hole 36 at an opposite end remote from the pivot rods 31, two retaining strips 33 longitudinally disposed at two opposite sides of the coupling hole 36, and a stop strip 32 longitudinally bridging the coupling hole 36.

The assembly process of the present invention is outlined hereinafter. The pivot rods 23 of the comb strip 20 are respectively pivoted to the recessed pivot holes 113 of the base plate 10, then the shoulders 26 of the comb strip 20 are forced into engagement between the upright lugs 12, permitting the comb strip 20 to be closed on the base plate 10 with a space 100 defined therebetween (see FIG. 2), and then the pivot rods 31 of the clamping plate 30 are respectively pivoted to the pivot holes 121 of the base plate 10, and then the retaining strips 33 of the clamping plate 30 are moved into engagement with the hooked retaining strips 112 of the base plate 10, permitting a part of the clamping plate 30 to be supported on the shoulders 122 of the upright lugs 12 of the base plate 10. The hooked retaining strips 112 preferably have a plurality of hooked portions disposed at different elevations for adjustably hooking on the retaining strips 33 of the clamping plate 30 subject to the desired clamping force.

Figure 4:
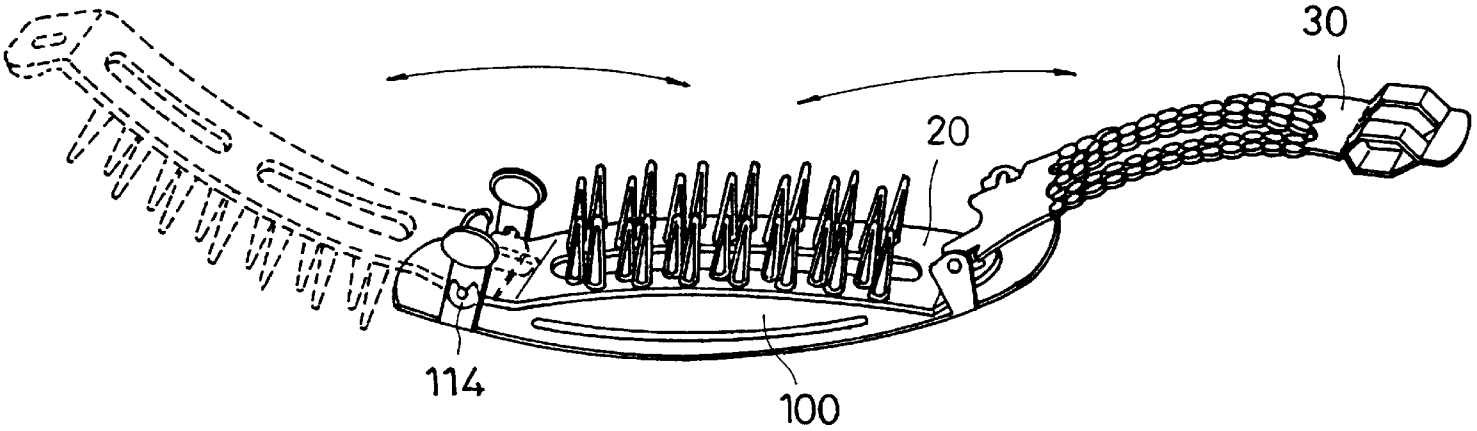
FIG. 4 is a schematic drawing of the present invention, showing the turning direction of the comb strip and the clamping plate relative to the base plate.
Figure 5:
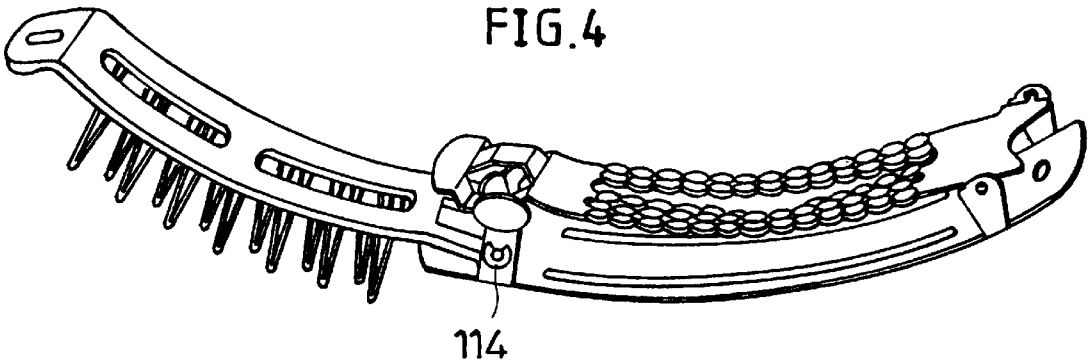
FIG. 5 shows the barrette arranged into the form of a hairbrush according to the present invention.

When the finger strips 111 are squeezed inwards, the hooked retaining strips 112 of the base plate 10 are disengaged from the retaining strips 33 of the clamping plate 30, and the clamping plate 30 is turned outwards from the base plate 10, permitting the coupling hole 24 to be coupled to the hooked retaining strips 112 of the base plate 10, and then the comb strip 20 is turned outwards to disengage its shoulders 26 from the upright lugs 12 (see FIG. 4), and then the clamping plate 30 is closed on the base plate 10 again to force the retaining strips 33 of the clamping plate 30 into engagement with the hooked retaining strips 112 of the base plate 10, and therefore the barrette is arranged into the form of a hairbrush for cleaning and smoothing the hair (see FIG. 5).

It is to be understood that the drawings are designed for purposes of illustration only, and are not intended as a definition of the limits and scope of the invention disclosed.

What the invention claimed is:

1. A combined barrette and comb, comprising:

a longitudinally extended base plate having a retainer unit formed on a first end thereof and a pair of spaced upright lugs formed on an opposing second end of said base plate, said retaining unit including a pair of hooked retaining strips respectively extending from a pair of upright finger strips;

a clamping plate having one end pivotally coupled to said base plate between said upright lugs and an opening formed in an opposing end for releasable coupling with said pair of hooked retaining strips; and, a comb strip having longitudinal rows of teeth extending from one side thereof and being of sufficient length to comb a user's hair, said comb strip having a first end pivotally coupled to said retainer unit and a second end extending to said pair of upright lugs when said comb strip is in a first position overlaying said base plate, said comb strip being maintained in said first position by said clamping plate being disposed in overlaying relationship and engaged by said pair of hooked retaining strips, said comb strip having a coupling hole formed therethrough adjacent said first end thereof for releasable coupling with said pair of hooked retaining strips when said comb strip is rotated into a second position wherein said comb strip extends from said base plate.

* * * * *